United States Patent [19]

Yasui et al.

[11] Patent Number: 4,479,348

[45] Date of Patent: Oct. 30, 1984

[54] APPARATUS FOR SPINNING FASCIATED YARN

[75] Inventors: Yoshiharu Yasui, Toyota; Kazuo Seiki, Kariya; Yoshihisa Suzuki, Chiryu; Hisao Amano, Aichi, all of Japan

[73] Assignee: Kabushiki Kaisha Toyoda Jidoshokki, Kariya, Japan

[21] Appl. No.: 435,888

[22] Filed: Oct. 21, 1982

[30] Foreign Application Priority Data

Oct. 27, 1981 [JP] Japan ..... 56-170765
Oct. 27, 1981 [JP] Japan ..... 56-170766

[51] Int. Cl.³ ..... D01H 5/28; D01H 1/135

[52] U.S. Cl. ..... 57/404; 57/328; 57/408

[58] Field of Search ..... 57/400, 403, 404, 408, 57/411, 414, 415, 417, 328

[56] References Cited

U.S. PATENT DOCUMENTS 3,901,012 8/1975 Safar ..... 57/404 X
4,044,537 8/1977 Negishi et al. ..... 57/414 X
4,322,942 4/1982 Fajt et al. ..... 57/411

*Primary Examiner*—John Petrakes
*Attorney, Agent, or Firm*—Burgess, Ryan & Wayne

[57] ABSTRACT

A spinning apparatus for a fasciated yarn is provided which comprises a fiber-opening means provided with a combing roller, a fiber-collecting means including an inlet member and a rotor, a twist-imparting means consisting of an air nozzle, and a yarn take-up means. A sliver opened by the combing roller is fed to the interior of the rotor through the inlet member. Since the rotor and the inlet member rotate reversely to each other, the fibers are evenly distributed on an inner surface of the rotor. An intermediate yarn drawn out from the rotor is supplied to the air nozzle under an overfeeding condition, whereby a good fasciating effect is imparted to the resultant yarn by a vortex. Prior to feeding the yarn to the air nozzle, the yarn may be drafted between two pairs of rollers. The apparatus is easy to maintain because a roller drafting means having an apron which rapidly wears due to high-speed processing is not utilized.

9 Claims, 4 Drawing Figures

APPARATUS FOR SPINNING FASCIATED YARN

BACKGROUND OF THE INVENTION

Prior Art Description

This invention relates to an apparatus for spinning a fasciated yarn.

Fasciated yarn spinning in which an untwisted fiber bundle attenuated by a so-called "roller drafting means" is continuously false-twisted by a vortex whirling within an air nozzle so that the edge portion fibers of the fiber bundle are entangled around a core portion of the fiber bundle to form a fasciated yarn has recently become well known. The roller drafting means comprises sequentially arranged pairs of top and bottom rollers, part of which may be provided with aprons. In general, the aprons and the top rollers are made of rubber or the like and become worn and damaged due to a high processing speed exceeding 150 meters/min.. Moreover, this problem is aggravated by a twist imparted to the fiber bundle due to the twisted fiber bundle scraping the contact surfaces of the top rollers or the aprons. If the rollers or the aprons are damaged, the fibers are apt to wind around the drafting means, thereby disturbing the normal drafting operation.

To eliminate the above-mentioned problem, an apparatus in which an air nozzle is combined with a rotor-type open-end spinning unit is provided in Japanese Unexamined Patent Publication (Kokai) No. 52-37837. In this apparatus, a sliver is supplied in a fully separated state to the interior of a rotor by an ejector. Then the sliver is drawn off from the rotor as a fiber bundle and is fed into an air nozzle, in which the fiber bundle is subjected to a vortex and surface fibers are entangled around a core portion. The resultant yarn obtained by means of this apparatus, however, is substantially a variation of an open-end spinning yarn and is basically different from a so-called fasciated yarn since the fiber bundle introduced into the air nozzle is a completely twisted yarn due to the rotation of the rotor and since the processing tension in the air nozzle directly corresponds to the yarn tension in the rotor, which tension is somewhat too high to obtain a good fasciating effect.

SUMMARY OF THE INVENTION

It is an object of the present invention to provide an apparatus for spinning a fasciated yarn, in which apparatus no rapidly wearing member, such as an apron, is utilized as a drafting means.

It is another object of the present invention to provide an apparatus for spinning a fasciated yarn having a truly twisted core portion.

Yet another object of the present invention is to provide an apparatus for spinning a thinner fasciated yarn having a good evenness.

Other objects and features of the present invention will be more fully understood hereinafter with reference to the accompanying drawings.

DESCRIPTION OF THE PREFERRED EMBODIMENTS

Figure 1:
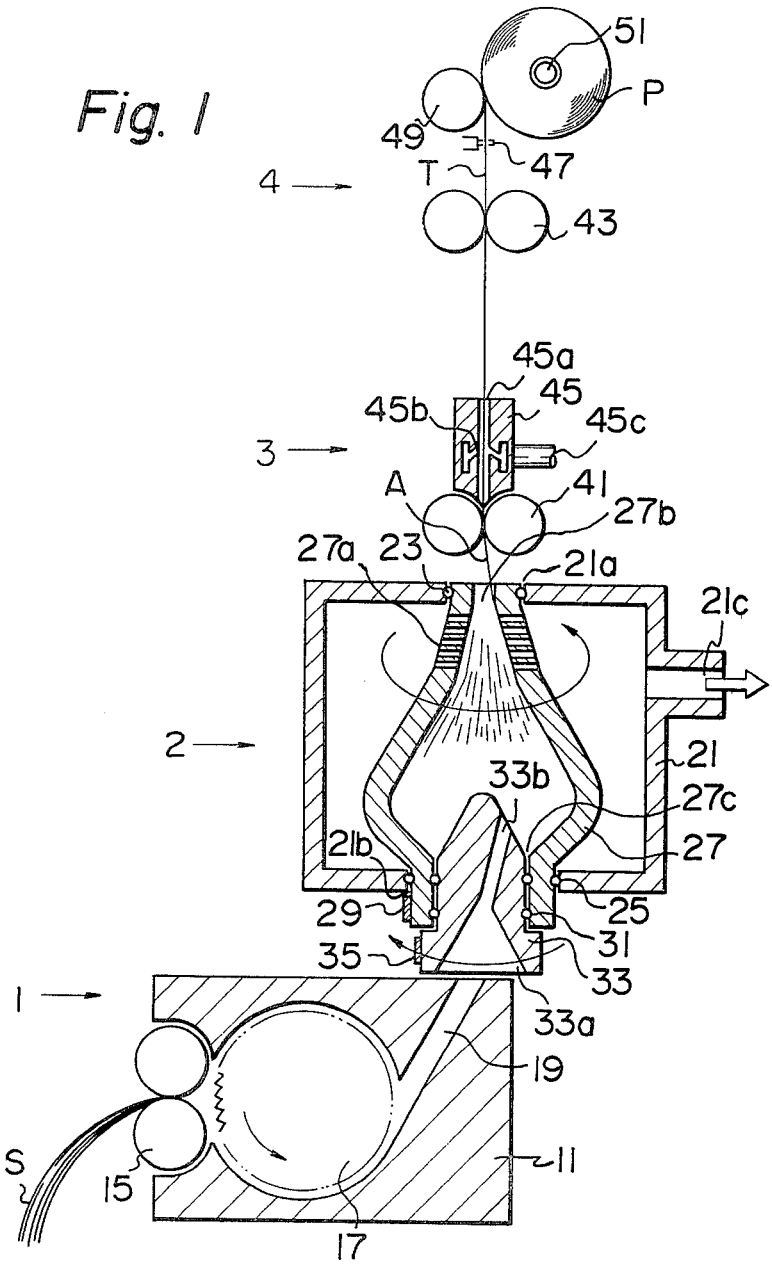
FIG. 1 schematically illustrates a side sectional view of a first embodiment according to the present invention, and FIGS. 2 to 4, which are the same views as FIG. 1, illustrate second, third, and fourth embodiments, respectively, according to the present invention.

A first embodiment, shown in FIG. 1, comprises a fiber-opening means 1, a fiber-collecting means 2, a twist-imparting means 3, and a yarn take-up means 4.

The fiber-opening means 1 consists of a pair of feed rollers 15, a combing roller 17, and a fiber-transporting channel 19, all of which are provided in a body 11. The feed rollers 15 are utilized to introduce a sliver S to the combing roller 17. The combing roller 17 is installed within a recess prepared in the midportion of the body 11 and is provided with a sawtooth wire for opening the sliver S supplied by the feed rollers 15. The fiber-transporting channel 19 conveys fibers opened by the combing roller 17 to the fiber-collecting means 2. Accordingly, the fiber-transporting channel 19 has an inlet facing the combing roller 17 and extends toward the fiber-collecting means 2 along a tangent to the periphery of the combing roller 17.

The fiber-collecting means 2 comprises an inlet member 33, a rotor 27, and a housing 21 which encloses the rotor 27. The housing 21 is of a substantially airtight construction and has openings 21*a* and 21*b* on a top wall and a bottom wall, respectively. The housing 21 is further provided with a connecting pipe 21*c* communicating with a suction means (not shown). The rotor 27 is rotatably supported by bearings 23 and 25 secured to an inner wall of the openings 21*a* and 21*b* so that the rotor 27 is housed within the housing 21. The rotor 27 is a hollow body, a top portion of which has a converging outlet 27*b*. In the vicinity of the converging outlet 27*b*, a plurality of ventilation apertures 27*a* are provided in a wall of the rotor 27, with the result that the interior of the rotor 27 and the interior of the housing 21 communicate each other. Since the rotor 27 rotates at a high speed, a ventilation stream flows from the interior of the rotor 27 to the interior of the housing 21 through the apertures 27*a*. This ventilation stream is facilitated during passage through the connecting pipe 21*c* by the suction effect of the suction source. A bottom portion of the rotor 27 protrudes from the housing 21 and a belt 29 engages the periphery of the bottom portion to drive the rotor 27.

The rotor 27 is inserted along with the inlet member 33 into an inlet opening 27*c* disposed opposite to the converging outlet 27*b*. The profile of the inlet member 33 is a cylindrical shape at the root portion and a conical shape at the nose portion. The inlet member 33 is rotatably supported by a bearing 31, and the rotation axis thereof is the same as that of the rotor 27.

The inlet member 33 has a conical-shaped inlet recess 33*a* at the end surface and is disposed downstream of the fiber-opening means 1 so that the inlet recess 33*a* faces the outlet of the fiber-transporting channel 19. A fiber path 33*b* is formed from the innermost portion of the recess 33*a* to the conical surface of the nose portion. Accordingly, the fiber path 33*b* deviates from the rotation axis of the inlet member 33. The inlet member 33 is driven by a belt 35 which engages the root portions of the inlet member 33. The moving direction of the belt 35 is reverse to that of the belt 29, and, as a result, the inlet member 33 rotates reversely to the rotor 27. The bearing 31 supporting the inlet member 33 may be secured to a stationary part, such as the housing 21, instead of to the above-mentioned rotor 27. Further, the profile of the inlet member 33 may be a cylindrical shape only.

Downstream of the outlet 27*b* of the rotor 27 are arranged two pairs of delivery rollers 41 and 43. The first delivery rollers 41 are rotatable at a higher peripheral speed than are the second delivery rollers 43, with the result that there is approximately 10% overfeeding between the two pairs of delivery rollers 41 and 43.

Just behind the first delivery rollers 41, a conventional-type air nozzle 45 is arranged as the twist-imparting means 3. The air nozzle 45 is provided with a yarn path 45*a* and a plurality of jets 45*b* surrounding the yarn path 45*a*. The jets 45*b* communicate with a high-pressure air source (not shown) through a duct 45*c*. When high-pressure air is supplied to the jets 45*b*, a vortex whirling around an axis of the yarn path 45*a* occurs and false-twists the yarn running through the yarn path 45*a*.

The yarn take-up means 4 is arranged downstream of the second delivery rollers 43 and comprises a take-up roller 49 which surface-drives a yarn package P formed on a bobbin 51 and a traverse guide 47 which reciprocally traverses a yarn T so as to cross-wind it to form the yarn package P.

The operation of the above-mentioned apparatus is as follows.

The sliver S introduced into the operation area of the combing roller 17 by the feed rollers 15 is opened and separated into individual fibers and then is supplied to the inlet recess 33*a* of the inlet member 33 through the fiber-transporting channel 19. The fibers are thrown off the fiber path 33*b* into the interior of the rotor 27 due to the centrifugal force caused by the rotation of the inlet member 33. Next, the fibers are evenly deposited on an inner surface of the rotor 27, which serves as a fiber-collecting surface, by the ventilation stream passing through the apertures 27*a* and by the above-mentioned centrifugal force, and thereby a fiber layer is formed. The fiber layer is continuously stripped from the inner surface of the rotor 27 and is drawn out through the converging outlet 27*b* of the rotor 27 by the first delivery rollers 41. During the drawing-off operation, the fiber layer is twisted, due to the rotation of the rotor 27, to form an intermediate yarn A.

In the above-mentioned operation, since the inlet member 33 and the rotor 27 rotate reversely to each other, a high relative speed can be achieved between the outlet of the fiber path 33*b* and the inner wall of the rotor 27. Due to this high relative speed, the fibers supplied into the interior of the rotor 27 can be evenly distributed on the inner surface of the rotor 27, and even if the supply rate of the fibers fluctuats somewhat there is no problem in the resultant yarn in respect to thickness.

Further, according to the present invention, the object of the rotor 27 is different from that in the case of the conventional open-end spinning system and the aforesaid Japanese Unexamined Patent Publication (Kokai) No. 52-37837. Namely, the rotor 27 of the present invention is not utilized as a twist-imparting means but is utilized mainly as a kind of drafting means. Accordingly, the rotational speed thereof may be as low as possible provided that the intermediate yarn has a tensile strength sufficient to withstand the drawing-off operation of the first delivery rollers 41. In the conventional system, such a low rotational speed of the rotor causes an unevenness in the resulant yarn. However, in the present invention the high relative speed between the inlet member 33 and the rotor 27 aids in overcoming this problem.

As stated before, since the peripheral speed of the first delivery rollers 41 exceeds that of the second delivery rollers 43, the intermediate yarn A is overfed in this area and the tension thereof is kept low enough so that a false twist is fully imparted to the intermediate yarn A due to the vortex whirling within the yarn path 45*a* of the air nozzle 45 and so that the intermediate yarn A is entangled with the free end fibers to form a fasciated yarn.

The resultant yarn T is delivered from the second delivery rollers 43 and is reciprocally traversed by the traverse guide 47. Then the yarn is wound on the bobbin 51 frictionally driven by the take-up roller 49 to form the package P.

Figure 2:
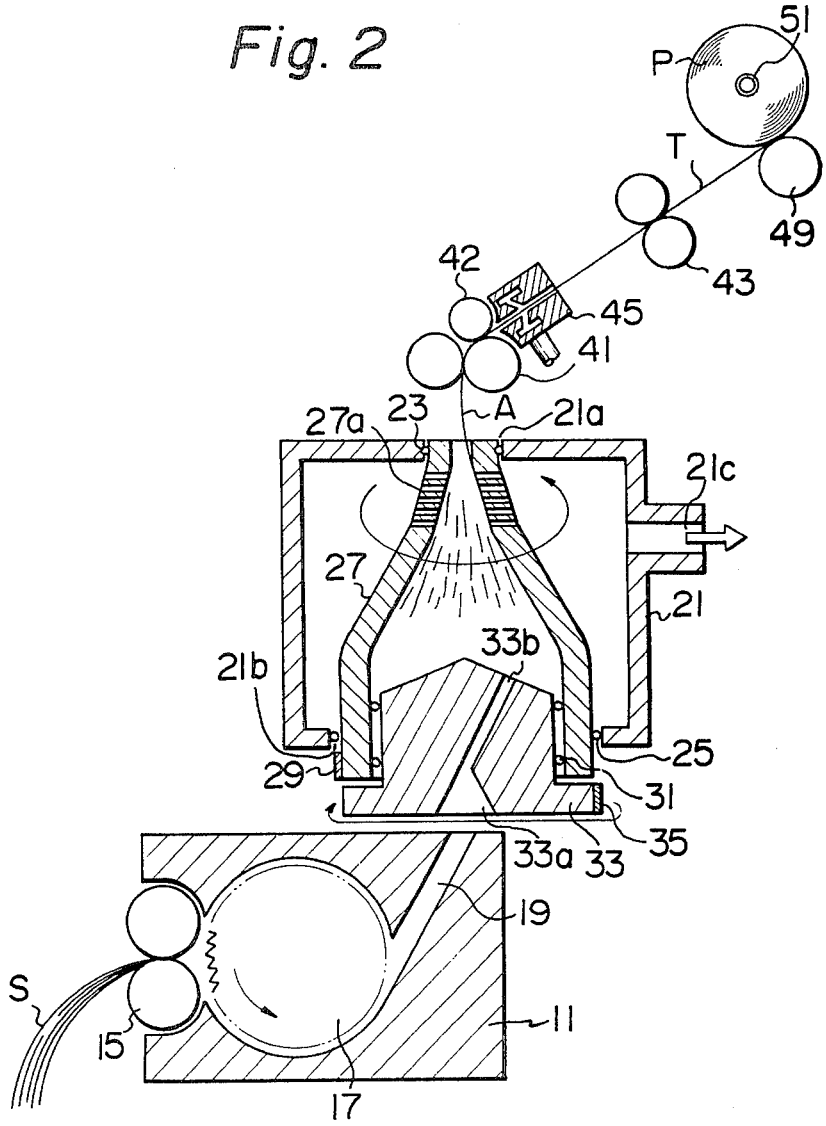

In FIG. 2, a second embodiment of the present invention is illustrated. This is a variation of the first embodiment. The second embodiment differs from the first embodiment as follows:

1. The profile of the rotor 27 is of a conical shape.
2. The yarn line conveyed by the first delivery rollers 41 to the second delivery rollers 43 is deflected from the yarn line supplied from the rotor 27 to the first delivery rollers 41 with the aid of a defection roller 42 disposed above the bottom side of a first delivery roller 41, the clearance between the rollers 42 and 41 being 0.1 to 0.5 mm. Deflection of the yarn line enhances the fasciating effect of the air nozzle 45.
3. A grooved drum is utilized, instead of the traverse guide 47, for traversing the resultant yarn T.

The functions of the second embodiment are substantially the same as those of the first embodiment.

Figure 3:
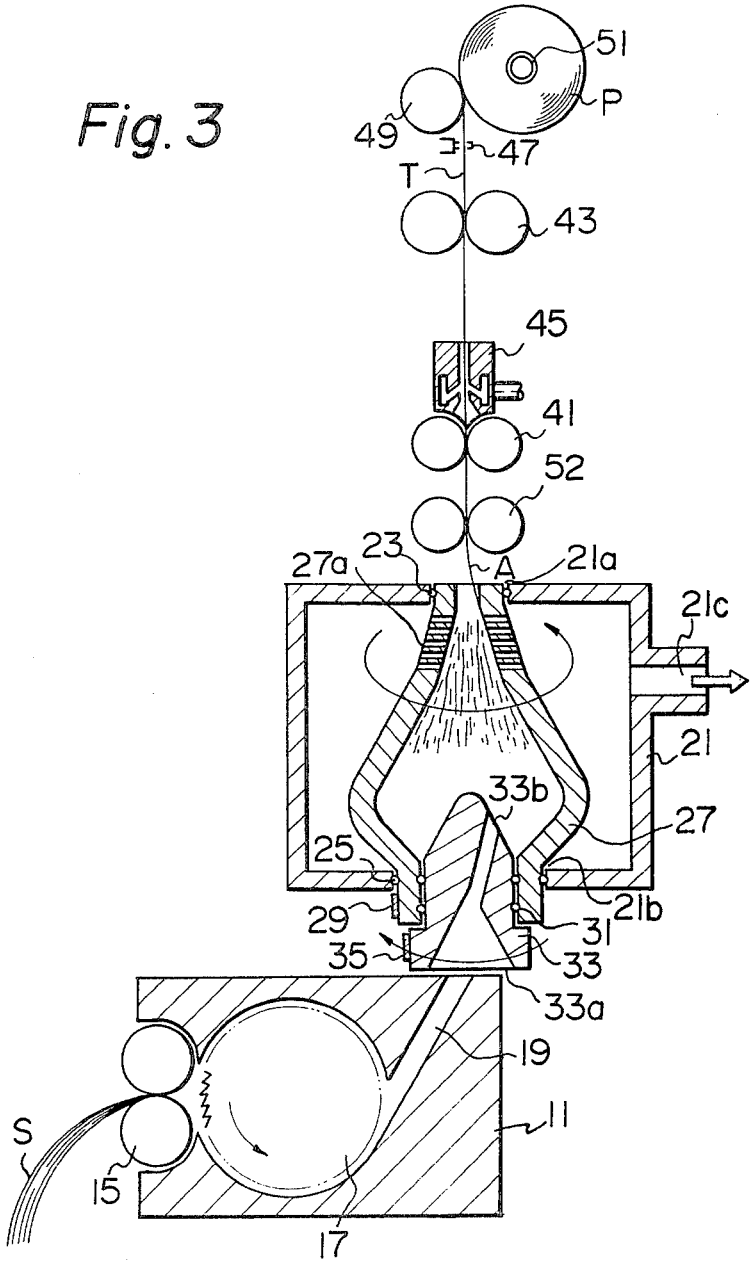

FIG. 3 illustrates a third embodiment of the present invention. In this embodiment, one pair of draft rollers 52 is added between the rotor 27 and the first delivery rollers 41 in the arrangement of the first embodiment shown in FIG. 1. The intermediate yarn A is drawn off from the inner surface of the rotor 27 by the draft rollers 52 and then is drafted at a suitable ratio between the draft rollers 52 and the first delivery rollers 41 since the peripheral speed of the first delivery rollers 41 faster than that of the draft rollers 52. Thereby, a thinner yarn to be fed into the air nozzle 45 can be prepared. Though the intermediate yarn A has a true twist, the twist is so little due to the slow rotation of the rotor 27 that the above-mentioned drafting can smoothly be carried out. The operations are exactly the same as those explained in the case of the first embodiment.

Figure 4:
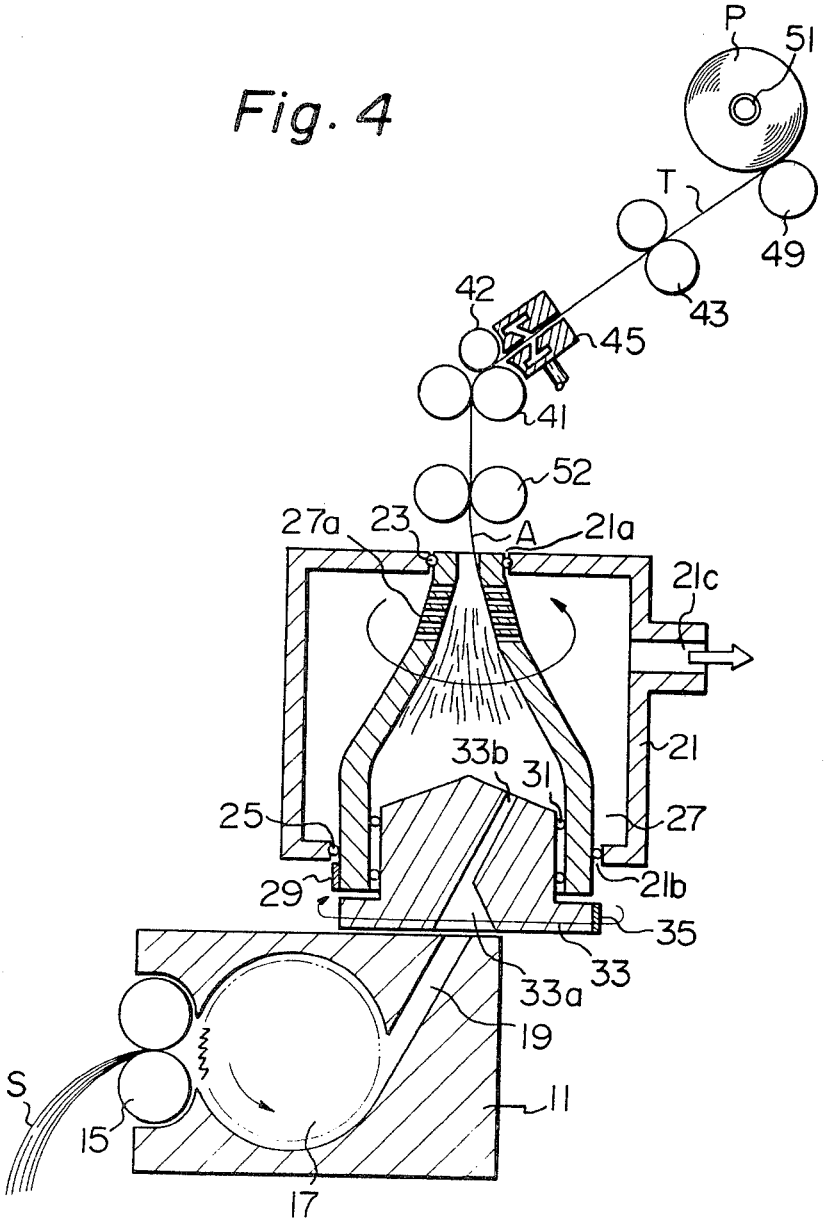

FIG. 4 illustrates a fourth embodiment of the present invention. In this embodiment also, one pair of draft rollers 52 is added between the rotor 27 and the first delivery rollers 41 in the arrangement of the second embodiment shown in FIG. 2. The function of the draft rollers 52 is exactly the same as explained in the case of the third embodiment.

According to the present invention, since the intermediate yarn A from the rotor 27 has a true twist due to the rotation of the rotor 27 and since a false twist is thereafter imparted to it by the air nozzle 45 under a low tension due to the overfeeding action between the first and the second delivery rollers 41 and 43, a well-fasciated yarn having a truly twisted core portion can be obtained.

Further, if the draft rollers 52 are arranged before the first delivery rollers 41, a thinner yarn can be spun. Since the inlet member 33 and the rotor 27 are rotated reversely to each other, the fibers from the inlet member 33 are deposited evenly on the inner surface of the rotor 27, and thereby a high quality yarn having a good evenness can be obtained.

In addition, the apparatus according to the present invention is easy to maintain since a roller drafting means comprising aprons is not utilized, the aprons being rapidly damaged and having to be replaced due to high-speed processing.

We claim:

1. An apparatus for spinning fasciated yarn, comprising a fiber-opening means for separating a supplied sliver into individual fibers, a fiber-collecting means for depositing said individual fibers on a fiber-collecting surface thereof, and an air nozzle for twisting said fibers in a shape of a continuous fiber bundle drawn off from said collecting surface by means of a vortex to form a resultant fasciated yarn, said spinning apparatus being characterized in that two pairs of first and second delivery rollers are arranged so that said air nozzle is disposed between said two pairs of first and second delivery rollers with said first delivery-rollers between the fiber-collecting means and the air nozzle, whereby said fiber bundle from said collecting surface can be processed within said air nozzle under an overfeeding condition.

2. An apparatus according to claim 1, characterized in that said fiber-collecting means comprises a rotor in the shape of a hollow body and an inlet member provided with a fiber passage, said inlet member being inserted coaxially into the interior of said rotor and being supported so as to be reversely rotatable in the direction of rotation of said rotor.

3. An apparatus according to claim 2, further comprising a pair of drafting rollers disposed between said rotor and said first delivery rollers, whereby said fiber bundle from said rotor can be drafted at a predetermined ratio between said draft rollers and said first delivery rollers prior to being fed to said air nozzle.

4. An apparatus according to claim 2 or 3, characterized in that said rotor has a converging outlet.

5. An apparatus according to claim 2, characterized in that said rotor is rotatably mounted within a housing having a substantially airtight construction and forced ventilating means.

6. An apparatus according to claim 5, wherein said fiber-opening means comprises a pair of feed rollers and a combing roller.

7. An apparatus for spinning fasciated yarn comprising:

a fiber-opening means for separating a supplied sliver into individual fibers;

a fiber-collecting means for depositing said individual fibers on a fiber-collecting surface thereof, said fiber-collecting means comprising a rotor in the shape of a hollow body and an inlet member provided with a fiber passage, said rotor having a plurality of ventilation apertures in a wall thereof, said inlet member being inserted coaxially into the interior of said rotor and being supported so as to be reversely rotatable in the direction of rotation of said rotor;

an air nozzle for twisting said fibers in a shape of a continuous fiber bundle drawn off from said fiber-collecting surface by means of a vortex to form a resultant fasciated yarn; and first and second pairs of delivery rollers arranged so that said air nozzle is disposed between said pairs of delivery rollers, whereby said fiber bundle from said fiber collecting surface can be processed within said air nozzle under an overfeeding condition.

8. Spinning apparatus according to claim 7, wherein said rotor is rotatably mounted within a housing having a substantially airtight construction and forced ventilating means.

9. Spinning apparatus according to claim 7, wherein said fiber-opening means comprises a pair of feed rollers and a combing roller.

* * * * *